US010584075B2

(12) United States Patent
Ackerman et al.

(10) Patent No.: US 10,584,075 B2
(45) Date of Patent: Mar. 10, 2020

(54) COMPOSITE REACTIVE MATERIAL FOR USE IN A MUNITION

(71) Applicant: MBDA UK LIMITED, Stevenage, Hertfordshire (GB)

(72) Inventors: Terence Alan Ackerman, Stevenage (GB); David Robert Crofts, Bolton (GB); Kiran Gulia, Birmingham (GB); Moataz Mohammad Mahmoud Attallah, Birmingham (GB); Jack Robert Harry Mellor, Lostock (GB)

(73) Assignee: MBDA UK LIMITED, Stevenage, Hertfordshire (GB)

( * ) Notice: Subject to any disclaimer, the term of this patent is extended or adjusted under 35 U.S.C. 154(b) by 358 days.

(21) Appl. No.: 15/308,483

(22) PCT Filed: May 1, 2015

(86) PCT No.: PCT/GB2015/051275

§ 371 (c)(1),
(2) Date: Nov. 2, 2016

(87) PCT Pub. No.: WO2015/166261

PCT Pub. Date: Nov. 5, 2015

(65) Prior Publication Data

US 2017/0073281 A1 Mar. 16, 2017

(30) Foreign Application Priority Data

May 2, 2014 (GB) ..... 1407775.4

(51) Int. Cl.
*C06B 27/00* (2006.01)
*F42B 12/20* (2006.01)
(Continued)

(52) U.S. Cl.
CPC ..... *C06B 27/00* (2013.01); *C06B 45/04* (2013.01); *F42B 12/207* (2013.01); *F42B 12/22* (2013.01);
(Continued)

(58) Field of Classification Search
CPC ..... C06B 27/00
See application file for complete search history.

(56) References Cited

U.S. PATENT DOCUMENTS 3,811,358 A 5/1974 Morse
3,830,673 A 8/1974 Fletcher et al.
(Continued)

FOREIGN PATENT DOCUMENTS

CN 1059400 A 3/1992
EP 2589449 A1 5/2013
(Continued)

OTHER PUBLICATIONS

International Search Report and Written Opinion dated Sep. 24, 2015 issued in PCT/GB2015/051275.
(Continued)

*Primary Examiner* — Aileen B Felton
(74) *Attorney, Agent, or Firm* — Scully Scott Murphy & Presser, P.C.

(57) ABSTRACT

A composite reactive material for use in a munition is disclosed. The composite reactive material comprises a metal lattice structure having interstitial spaces and a powder in the interstitial spaces. The powder comprises at least one metal powder and/or at least one halogen-containing polymer powder.

20 Claims, 5 Drawing Sheets

(51) Int. Cl.

| | |
|---|---|
| ***F42B 12/22*** | (2006.01) |
| ***F42B 12/36*** | (2006.01) |
| ***F42B 12/74*** | (2006.01) |
| ***F42B 12/32*** | (2006.01) |
| ***F42B 12/44*** | (2006.01) |
| ***C06B 45/04*** | (2006.01) |

(52) U.S. Cl.
CPC ..... *F42B 12/32* (2013.01); *F42B 12/36* (2013.01); *F42B 12/44* (2013.01); *F42B 12/74* (2013.01); *F42B 12/745* (2013.01)

(56) References Cited

U.S. PATENT DOCUMENTS

| | | | | |
|---|---|---|---|---|
| 4,815,386 | A * | 3/1989 | Dillard | B22F 3/114 102/364 |
| 5,062,365 | A | 11/1991 | Canterberry | |
| 7,383,775 | B1 | 6/2008 | Mock, Jr. et al. | |
| 2003/0096897 | A1 | 5/2003 | Nielson et al. | |
| 2004/0020397 | A1 | 2/2004 | Nielson et al. | |
| 2005/0067072 | A1 * | 3/2005 | Vavrick | C06B 27/00 149/37 |
| 2005/0235862 | A1 | 10/2005 | Gousman et al. | |
| 2009/0151591 | A1 * | 6/2009 | Ohlsson | F42B 12/76 102/473 |
| 2011/0132222 | A1 * | 6/2011 | Sheridan | C06B 33/00 102/473 |

FOREIGN PATENT DOCUMENTS

| | | |
|---|---|---|
| FR | 2584393 A1 | 1/1987 |
| GB | 2459360 A | 10/2009 |

OTHER PUBLICATIONS

GB Search Report dated Apr. 23, 2015 issued in GB1407775.4.
Gorny, B., "In situ characterization of the deformation and failure behavior of non-stochastic porous structures processed by selective laser melting", Materials Science and Engineering A (2011), vol. 528, No. 27, pp. 7962-7967.
International Preliminary Report on Patentability and Written Opinion dated Nov. 17, 2016 from PCT/GB2015/051275.

* cited by examiner

COMPOSITE REACTIVE MATERIAL FOR USE IN A MUNITION

FIELD OF THE INVENTION

This invention relates to the field of reactive materials for use in munitions. More particularly, but not exclusively, this invention concerns reactive materials for use in charge liners, casings and preformed fragments in warheads and other conventional munitions such as bombs and gun ammunition.

BACKGROUND ART

Reactive materials comprising an oxidising agent, such as a fluoropolymer, and a metal have been used to make parts, for example liners or fragments in warheads. Such parts of the warhead would previously have been made from inert materials. By using reactive materials in such parts, the energy available during detonation of the warhead can be increased. The energy may be released either as a result of shock induced reaction of the reactive material in the detonation fireball or as a result of impact induced reaction of the reactive material at the target. The use of reactive materials can increase lethality or reduce warhead weight and volume whilst maintaining lethality. In order to be useful, such materials must have sufficient strength to replace at least some of the inert materials in the warhead.

US2003/0096897 discloses a sintered reactive material made by blending fuel particles with a polymer matrix comprising at least one fluoropolymer in an inert organic media to disperse the fuel particles in the polymer matrix. The material is sintered in an inert atmosphere so as to include reactive metals and/or metalloids in a non-oxidised state.

US2004/0020397 discloses a reactive material for use as a reactive liner in penetrating warheads and for use in reactive fragments in fragmenting warheads. The reactive material comprises an oxidising agent and a metal filler or metal/metal oxide filler.

Despite these advances, there is still a need for improved reactive materials for use in munitions design. In particular, there is a need for reactive materials having good structural properties whilst still providing high energy release during munition detonation, whether through shock induced reaction of impact induced reaction.

It would be advantageous to provide a reactive material for use in munitions in which one or more of the aforementioned disadvantages is eliminated or reduced.

DISCLOSURE OF THE INVENTION

A first aspect of the invention provides a composite reactive material for use in a munition, the composite reactive material comprising a metal lattice structure having interstitial spaces and a powder in the interstitial spaces, the powder comprising at least one metal powder and/or at least one halogen-containing polymer powder.

The munition may be a warhead, a bomb or ammunition (for example, gun ammunition). Preferably the munition is a warhead.

Such a composite combines the high strength of the metal lattice structure with the high surface area, and hence rapid energy release, of the powder. While the metal lattice structure may be sintered, for example as a result of it being made using selective laser melting, the powder is preferably held in the lattice by virtue of consolidation and there is thus no need to use processing in inert environments to avoid oxidisation of the reactive material.

Preferably the metal lattice structure is made from titanium, aluminium, zirconium, hafnium, tantalum, molybdenum, tungsten, iron or alloys thereof. Preferably the metal lattice structure is made using selective laser melting (SLM). SLM is a known technique for the production of metals structures. In this case, SLM has the advantage that a finely meshed metal lattice structure can be formed which can then hold the powder in the interstitial spaces of the lattice structure.

Preferably the porosity of the metal lattice structure is in the range 15%-85% by volume, more preferably in the range 25%-75% by volume and even more preferably in the range 45%-55% by volume. Such porosities may provide the desirable balance between strength and quantity of powder, which is the more reactive part of the composite material.

Preferably the mesh size of the metal lattice structure is in the range 0.5-5 mm, more preferably in the range 0.5-4 mm, for example in the range 1-4 mm. It may be that the mesh is as fine as possible within the constraints of the manufacture process and strength properties. A mesh size of less than 0.5 mm may be preferable. Such mesh sizes may provide the desirable balance between strength and quantity of powder in the composite material and may be suited to holding the powder within the lattice.

Preferably the metal powder comprises at least one of tantalum, aluminium, aluminium alloys, iron, zirconium, titanium, hafnium or tungsten. The metal powder may comprise alloys of those materials. Such metal powders advantageously have high density and high reactivity. Preferably the halogen-containing polymer is a fluoropolymer, more preferably a thermoplastic fluoropolymer. Preferably the fluoropolymer comprises at least one of PFA, PTFE, THV, Viton, Fluore or Kel. Such fluoropolymers advantageously have low melt temperature and high mechanical strength. It may be that the powder comprises at least one metal powder and at least one halogen-containing polymer powder. It may be that the powder comprises at least two metal powders and at least two halogen-containing polymer powders. Such powders may enhance reactivity.

Preferably the powder has an average grain size of less than 15 micrometres. Such a grain size may aid consolidation and may also ensure a sufficiently large surface area for fast reaction.

Preferably the powder comprises from 40% to 60% by weight metal powder, with the remaining 60% to 40% by weight being halogen-containing polymer powder. Such a ratio may give the optimum quantities of fuel and oxidant for reaction.

Preferably the powder is consolidated in the interstitial spaces. A consolidated powder may be advantageous in that a consolidated powder may remain securely packed within the interstitial spaces. Consolidation may also increase the mass of powder within the interstitial spaces, thus increasing the available energy release. Consolidation may be advantageous in that the consolidation process may avoid the oxidisation of the components of the powder. It will be appreciated that non-oxidised components advantageously provide greater energy release than would be provided by oxidised components. Thus it may be that manufacture, including consolidation, takes place in an inert atmosphere.

Preferably the porosity of the composite reactive material is in the range 0%-20% by volume, more preferably in the range 5%-20% by volume. Preferably the porosity of the composite reactive material is less than 0.5%. However, porosities of up to 50% may be preferred to enhance reactivity.

The powder may be consolidated in the interstitial spaces by cold isostatic pressing (CIP) or hot isostatic pressing (HIP).

Preferably the metal lattice structure comprises a multi-layered mesh framework. Such a framework may be particularly suited to holding the powder. Preferably the metal lattice structure comprises a uniform mesh. Preferably the mesh comprises legs having a thickness of less than 500 micron, preferably less than 300 micron, more preferably from 50 to 300 micron, for example around 250 micron. Such legs may increase surface area and hence reactivity. Preferably the mesh comprises a plurality of interlinked interstitial spaces. The interlinked interstitial spaces may be wide compared to the powder size, for example greater than 2 times the powder size, or greater than 10 times the powder size. Such interlinked interstitial spaces may aid infiltration of the powder. The metal lattice structure may be produced to be near-netshape using SLM but is preferably produced to be netshape using SLM.

In some embodiments, the provision of the metal lattice alone may be sufficient to improve the munition. In such embodiments the air that fills the lattice may react with the metal lattice to release energy. Thus in a broad aspect, the invention may provide a composite reactive material for use in a munition, the composite reactive material comprising a metal lattice structure having interstitial spaces and air in the interstitial spaces.

A second aspect of the invention provides a method of producing a composite reactive material for use in a munition, the method comprising:

using selective laser melting to fabricate a metal lattice structure having interstitial spaces infiltrating a powder comprising at least one metal powder and/or at least one halogen-containing polymer powder into the interstitial spaces; and consolidating the powder in the interstitial spaces.

Such a method may result in a composite that combines the high strength of the metal lattice structure with the high surface area, and hence high reactivity of the powder. The composite reactive material can therefore be used to replace inert materials in a munition and provides sufficient strength whilst increasing the energy available for lethality from those parts of the munition. The munition may be a warhead, a bomb or ammunition (for example, gun ammunition). Preferably the munition is a warhead.

Preferably cold isostatic pressing or hot isostatic pressing is used to aid infiltration of the powder into the interstitial spaces. That is, the powder may be infiltrated into the interstitial spaces while the composite material being formed is undergoing hot or cold isostatic pressing. Cold isostatic pressing or hot isostatic pressing may increase the efficiency with which the powder infiltrates the interstitial spaces and hence result in reduced porosity. Cold isostatic pressing may be particularly advantageous in that it does not involve heating and there is therefore reduced possibility for oxidisation. Hot isostatic pressing may aid powder flow into the interstitial spaces during infiltration, for example by softening the polymer. Hot isostatic pressing may also help avoid the formation of micro-cracks in polymer powders.

Preferably cold isostatic pressing or hot isostatic pressing is used to consolidate the powder in the interstitial spaces.

Preferably the metal lattice structure comprises a multi-layered mesh framework. Such a framework may be particularly suited to holding the powder. Preferably the metal lattice structure comprises a uniform mesh. Preferably the mesh comprises legs having a thickness of less than 500 micron, preferably less than 300 micron, more preferably from 50 to 300 micron, for example around 250 micron. Such legs may increase surface area and hence reactivity. Preferably the mesh comprises a plurality of interlinked interstitial spaces. The interlinked interstitial spaces may be wide compared to the powder size, for example greater than 2 times the powder size, or greater than 10 times the powder size, Such interlinked interstitial spaces may aid infiltration of the powder.

Preferably the porosity of the metal lattice structure is in the range 15%-85% by volume, more preferably in the range 25%-75% by volume and even more preferably in the range 45%-55% by volume. Such porosities may provide the desirable balance between strength and quantity of powder, which is the main source of energy, in the composite material.

Preferably the mesh size of the metal lattice structure is in the range 0.5-5 mm, more preferably in the range 0.5-4 mm, for example in the range 1-4 mm. It may be that the mesh is as fine as possible within the constraints of the manufacture process and strength properties. A mesh size of less than 0.5 mm may be preferable. Such mesh sizes may provide the desirable balance between strength and quantity of powder in the composite material and may be suited to holding the powder within the lattice.

Preferably the metal powder comprises at least one of tantalum, aluminium, aluminium alloys, iron, zirconium, titanium, hafnium or tungsten. The metal powder may comprise alloys of those materials. Preferably the halogen-containing polymer is a fluoropolymer. Preferably the fluoropolymer comprises at least one of PFA, PTFE, THV, Viton, Fluore or Kel. Preferably the powder comprises two metal powders and two halogen-containing polymer powders.

Preferably the porosity of the composite reactive material is in the range 0%-20% by volume, more preferably in the range 5%-20% by volume. Preferably the porosity of the composite reactive material is less than 0.5%. However, porosities of up to 50% may be preferred to enhance reactivity.

The powder may be consolidated in the interstitial spaces by cold isostatic pressing (CIP) or hot isostatic pressing (HIP). For example, the consolidation may take place by CIP at 100-200 MPa and room temperature. The consolidation may take place by HIP at 100-200 MPa and 320-360° C.

A third aspect of the invention provides a munition, for example a bomb, ammunition or a warhead, comprising a composite reactive material according to the first aspect of the invention or a composite material manufactured according to the second aspect of the invention. Preferably the munition comprises a liner comprising the composite reactive material. Preferably the munition comprises a casing comprising the composite reactive material. Preferably the munition comprises pre-formed fragments comprising the composite reactive material. Preferably the composite reactive material is used in the manufacture of a part or parts of the munition that would previously have been made using a non-reactive material.

Preferably the munition is a warhead. Preferably the warhead comprises a liner, for example a Buxton liner, comprising the composite reactive material. The Buxton liner preferably comprises a dense metal (i.e. a solid section of metal, not a metal lattice) base and top to prevent warping. Preferably the warhead comprises a casing comprising the composite reactive material. Preferably the warhead comprises pre-formed fragments comprising the composite reactive material. Preferably the composite reactive material is used in the manufacture of a part or parts of the warhead that would previously have been made using a non-reactive material.

It will of course be appreciated that features described in relation to one aspect of the present invention may be incorporated into other aspects of the present invention. For example, the composite reactive material of the invention may incorporate any of the features described with reference to the method of the invention and vice versa.

BRIEF DESCRIPTION OF THE DRAWINGS

Example embodiments of the invention will now be described by way of example only and with reference to the accompanying drawings, of which.

DETAILED DESCRIPTION

Figure 1:
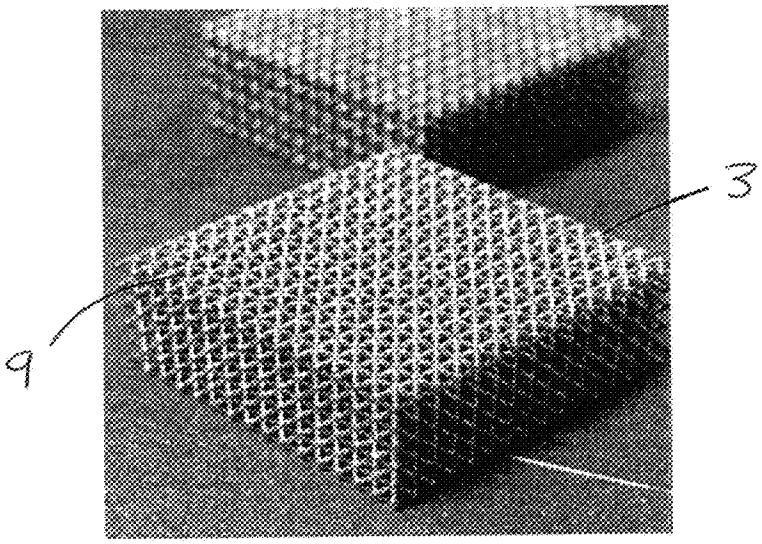
FIG. 1 is a view of a metal lattice structure of a first embodiment of the invention.

In FIG. 1 a metal lattice structure 3 has been produced by selective laser melting (SLM). The metal lattice structure 3 is a multi-layered mesh structure made from a Titanium alloy. The metal lattice structure 3 comprises interstitial spaces 9 into which a powder can be infiltrated.

Figure 2:
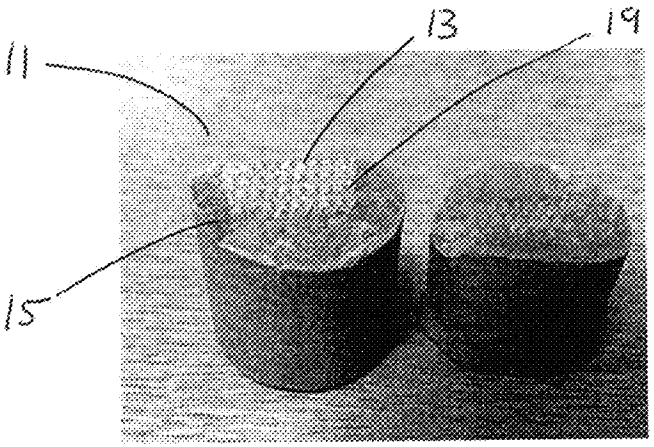
FIG. 2 is a view of a composite reactive material according to a second embodiment of the invention.

In FIG. 2 a composite reactive material 11 is formed from a metal lattice structure 13 and a powder 15 infiltrated into the interstitial spaces 19 and consolidated. The powder 15 comprises titanium powder and PTFE powder and has been cold isostatic pressed. The metal lattice structure 13 is made from a titanium alloy.

Figure 3:
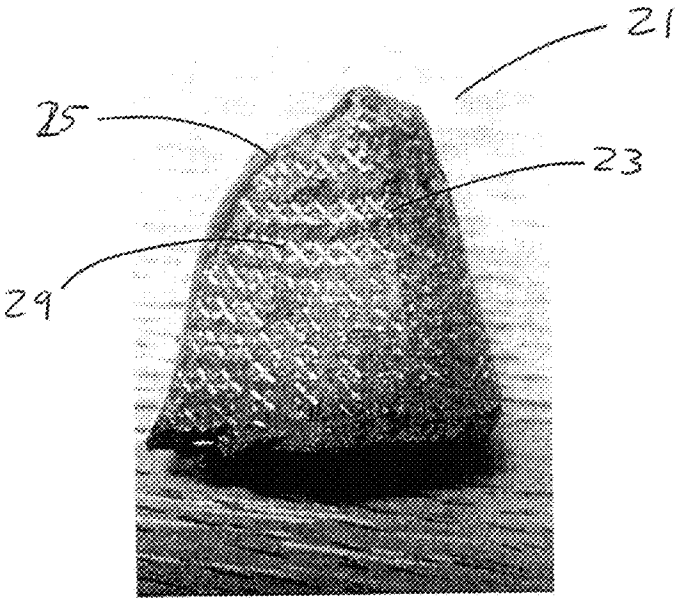
FIG. 3 is a view a composite reactive material according to a third embodiment of the invention.

In FIG. 3 a composite reactive material 21 is formed from a metal lattice structure 23 and a powder 25 infiltrated into the interstitial spaces 29 and consolidated. The powder 25 comprises titanium powder and PTFE powder and has been hot isostatic pressed at 150 MPa and 340° C. The metal lattice structure 23 is made from titanium.

Figure 4:
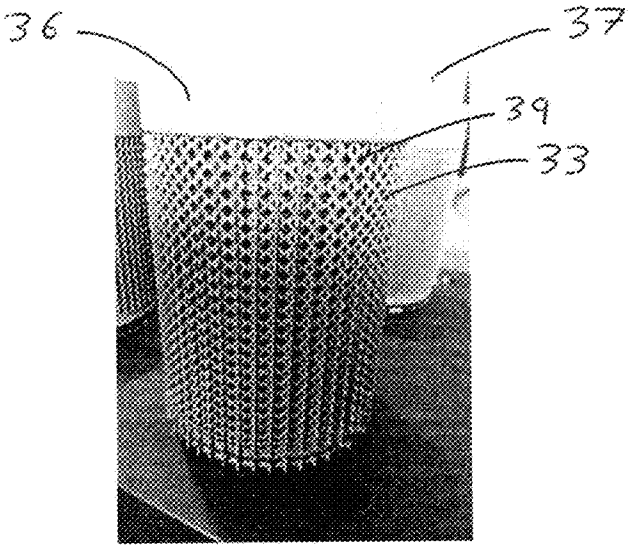
FIG. 4 is a view of a metal lattice structure of a fourth embodiment of the invention.

In FIG. 4 a metal lattice structure 33 in the form of a warhead casing 37 has been produced by SLM. The metal lattice structure 33 is a multi-layered mesh structure made from a titanium alloy. The metal lattice structure 33 comprises interstitial spaces 39 into which a powder can be infiltrated. The metal lattice structure 33 has a porosity of 75% by volume with a mesh size of 4 mm. The warhead casing 37 has a dense metal top 36 to provide dimensional stability.

Figure 5:
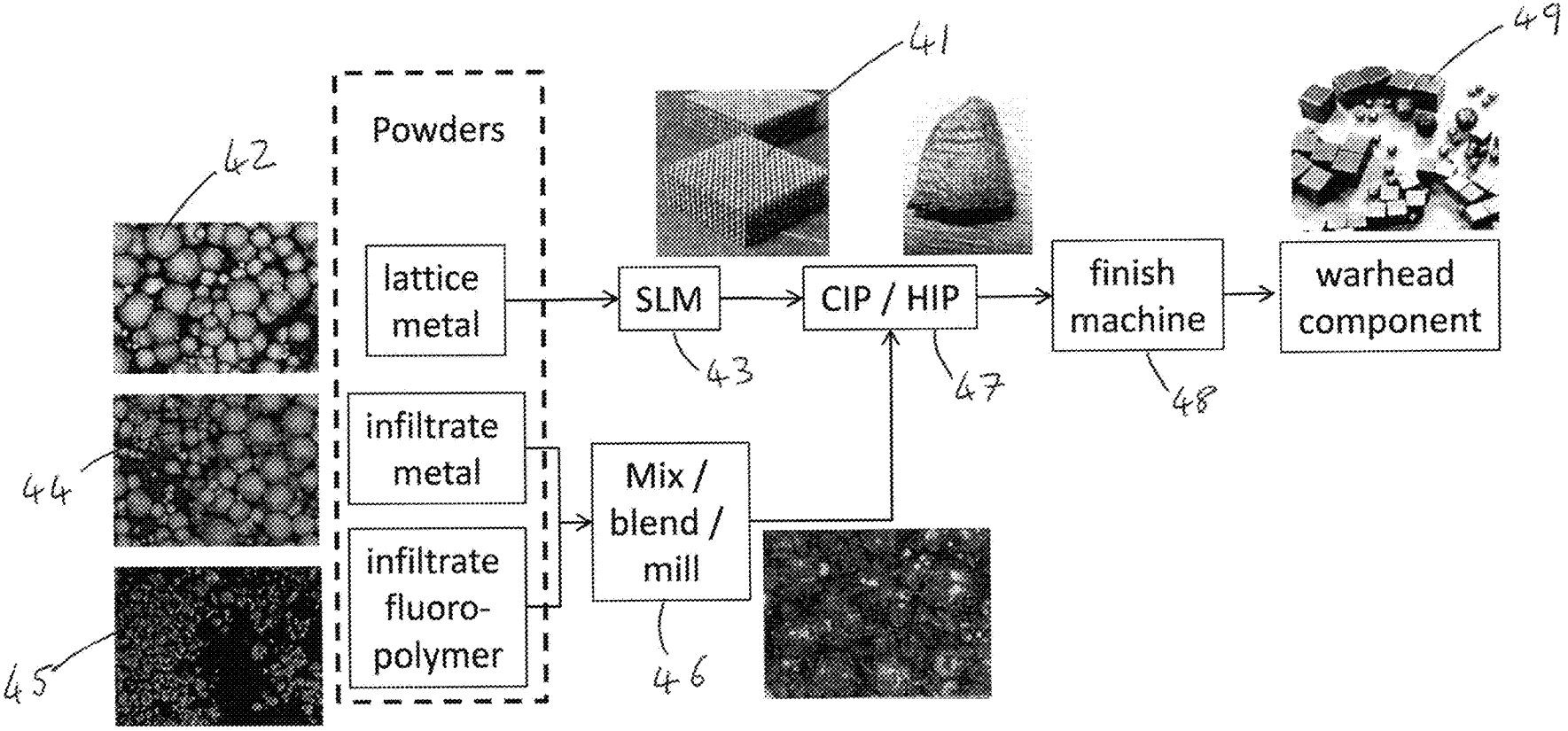
FIG. 5 is a schematic flowchart of a manufacturing process according to a fifth embodiment of the invention.

In FIG. 5 a lattice 41 is formed from a metal powder 42 by SLM 43. A metal powder 44 and a fluoropolymer powder 45 are mixed, blended and milled 46 and infiltrated into the lattice 41 using hot or cold isostatic pressing 47. The resulting composite is finished by machining 48 to produce a warhead component 49.

Whilst the present invention has been described and illustrated with reference to particular embodiments, it will be appreciated by those of ordinary skill in the art that the invention lends itself to many different variations not specifically illustrated herein. For example, the metal lattice structure may have a porosity of 50% by volume with a mesh size of 3 mm or a porosity of 25% by volume with a mesh size of 2 mm.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may be absent in other embodiments.

The invention claimed is:

1. A method of producing a composite reactive material for use in a munition, the method comprising:

a. selective laser melting of a metal powder to fabricate a metal lattice structure having interstitial spaces;

b. infiltrating a powder comprising at least one metal powder or at least one halogen-containing polymer powder into the interstitial spaces; and c. consolidating the powder in the interstitial spaces.

2. A method according to claim 1 wherein cold isostatic pressing or hot isostatic pressing is used to aid infiltration of the powder into the interstitial spaces.

3. A method according to claim 1 wherein cold isostatic pressing or hot isostatic pressing is used to consolidate the powder in the interstitial spaces.

4. A method according to claim 1 wherein the porosity of the metal lattice structure is in the range 15%-85% by volume.

5. A method according to claim 1 wherein the mesh size of the metal lattice structure is in the range 0.5-5 mm.

6. A method according to claim 1 wherein the metal powder comprises at least one of titanium, aluminium, zirconium, hafnium, tantalum, molybdenum, tungsten, iron or alloys thereof.

7. A method according to claim 1 wherein the halogen-containing polymer is a fluoropolymer.

8. A method according to claim 7 wherein the fluoropolymer comprises at least one of PFA, PTFE, THV, Viton, Fluore or Kel.

9. A method according to claim 1 wherein the powder comprises at least one metal powder and at least one halogen-containing polymer powder.

10. A method according to claim 9 wherein the powder comprises two metal powders and two halogen-containing polymer powders.

11. A method according to claim 1 wherein the porosity of the composite reactive material is 0-20%.

12. A method according to claim 1 wherein the metal lattice structure comprises a multilayered mesh framework.

13. A method according to claim 1 wherein the metal lattice structure comprises a uniform mesh.

14. A method according to claim 1 wherein the metal lattice structure comprises legs having a thickness of less than 500 micron.

15. A method according to claim 1 wherein the metal lattice structure comprises legs having a thickness of less than 300 micron.

16. A method according to claim 1 wherein the metal lattice structure comprises a plurality of interlinked interstitial spaces.

17. A method according to claim 16 wherein the interlinked interstitial spaces are greater than 2 times the powder size.

18. A method according to claim 16 wherein the interlinked interstitial spaces are greater than 10 times the powder size.

19. A method according to claim 1 wherein the metal lattice structure is produced to be netshape using selective laser melting.

20. A method according to claim 1 wherein the metal lattice structure is produced to be near netshape using selective laser melting.

* * * * *